US005411407A

United States Patent [19]

Thomas

[11] Patent Number: 5,411,407

[45] Date of Patent: May 2, 1995

[54] LAMP SOCKET

[75] Inventor: Ronald E. Thomas, Warren, Pa.

[73] Assignee: Osram Sylvania Inc., Danvers, Mass.

[21] Appl. No.: 300,625

[22] Filed: Sep. 2, 1994

[51] Int. Cl.[6] ..... H01R 13/52

[52] U.S. Cl. ..... 439/271; 439/611

[58] Field of Search ..... 439/699, 918, 638, 358, 439/651, 3, 5, 701

[56] References Cited

U.S. PATENT DOCUMENTS

| | | | |
|---|---|---|---|
| 3,668,603 | 6/1972 | Burgess et al. | 439/653 |
| 4,430,983 | 2/1984 | Hagen | 439/638 |
| 4,569,005 | 2/1986 | Bergin et al. | 362/267 |
| 4,573,754 | 3/1986 | Hill . | |
| 4,631,651 | 12/1986 | Bergin et al. | 362/267 |
| 5,029,057 | 7/1991 | Devir et al. | 362/226 |
| 5,035,643 | 7/1991 | Forish et al. | 439/699 |
| 5,080,615 | 1/1992 | Kondo | 439/699 |
| 5,121,304 | 6/1992 | Hall et al. | 362/61 |
| 5,160,281 | 11/1992 | Culver et al. | 439/692 |
| 5,197,187 | 3/1993 | Thomas | 29/863 |

*Primary Examiner*—Larry I. Schwartz
*Assistant Examiner*—Jill DeMello
*Attorney, Agent, or Firm*—William H. McNeill

[57] ABSTRACT

A lamp socket comprising: a body disposed about a longitudinal axis and having a cavity therein for receiving a plurality of electrical contacts; a bottom to said cavity; a plurality of apertures in said bottom; a plurality of electrical contacts in said cavity, each of said contacts having a lamp receiving portion within said cavity and an elongated terminal portion extending through said apertures and being bent at substantially 90 degrees to said longitudinal axis, said elongated terminal portions extending beyond the periphery of said body; latching tabs formed on said body adjacent said bottom; and a housing having a body receiving compartment and an elongated terminal portion receiving shroud joined to said housing, said body receiving compartment including latching slots for cooperative engagement with said latching tabs, said body being mounted in said body receiving compartment with said latching tabs being engaged with said latching slots.

5 Claims, 7 Drawing Sheets

LAMP SOCKET

TECHNICAL FIELD

This invention relates to lamp sockets and more particularly to lamp socket for an automotive application.

BACKGROUND ART

The need for a lamp socket which will retain a lamp in a satisfactory manner regardless of random mechanical vibration generated by conditions internal and external of a motor vehicle is well known. Heretofore, lamp sockets have been provided which include dual retention beams which are molded as pan of the socket insulation. Although the lamp is retained by such beams, a significant amount of undesirable lateral lamp movement occurs. Such lateral movement is detrimental to contact interface and is a common area of failure. In such lamp sockets the socket wires are typically terminated by means of a mechanical crimp and then sealed in place by potting or by a separate gasket. The process of assembling such a lamp socket includes more steps and greater cost than is desirable.

The above problems were addressed and solved by the solution presented in U.S. Pat. No. 5,197,187; however, this solution introduced other concerns such as multiple plastic parts utilizing blade components that were terminated by interference joints or mechanical crimping. The plastic parts were joined by ultrasonic welding or cantilever latching beams within the plastic component which contributed to a relatively high cost.

DISCLOSURE OF THE INVENTION

It is, therefore, an object of the present invention to obviate the disadvantages of the prior art.

It is another object of the invention to enhance lamp sockets.

Yet another object of the invention is improvement of electrical contact in sockets.

These objects are accomplished, in one aspect of the invention, by the provision of a lamp socket which comprises a body disposed about a longitudinal axis and having a cavity therein for receiving a plurality of electrical contacts. A bottom is formed in the cavity and has a plurality of apertures therein. Electrical contacts are positioned in the cavity, and each of the contacts has a lamp receiving portion within the cavity and an elongated terminal portion extending through the apertures and being bent at substantially 90 degrees to the longitudinal axis, these elongated terminal portions extend beyond the periphery of the body;. Latching tabs are formed on the body adjacent the bottom. A housing having a body receiving compartment and an elongated terminal portion receiving shroud joined to said housing is provided, the body receiving compartment including latching slots for cooperative engagement with the latching tabs, the body being mounted in the body receiving compartment with the latching tabs being engaged with the latching slots.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
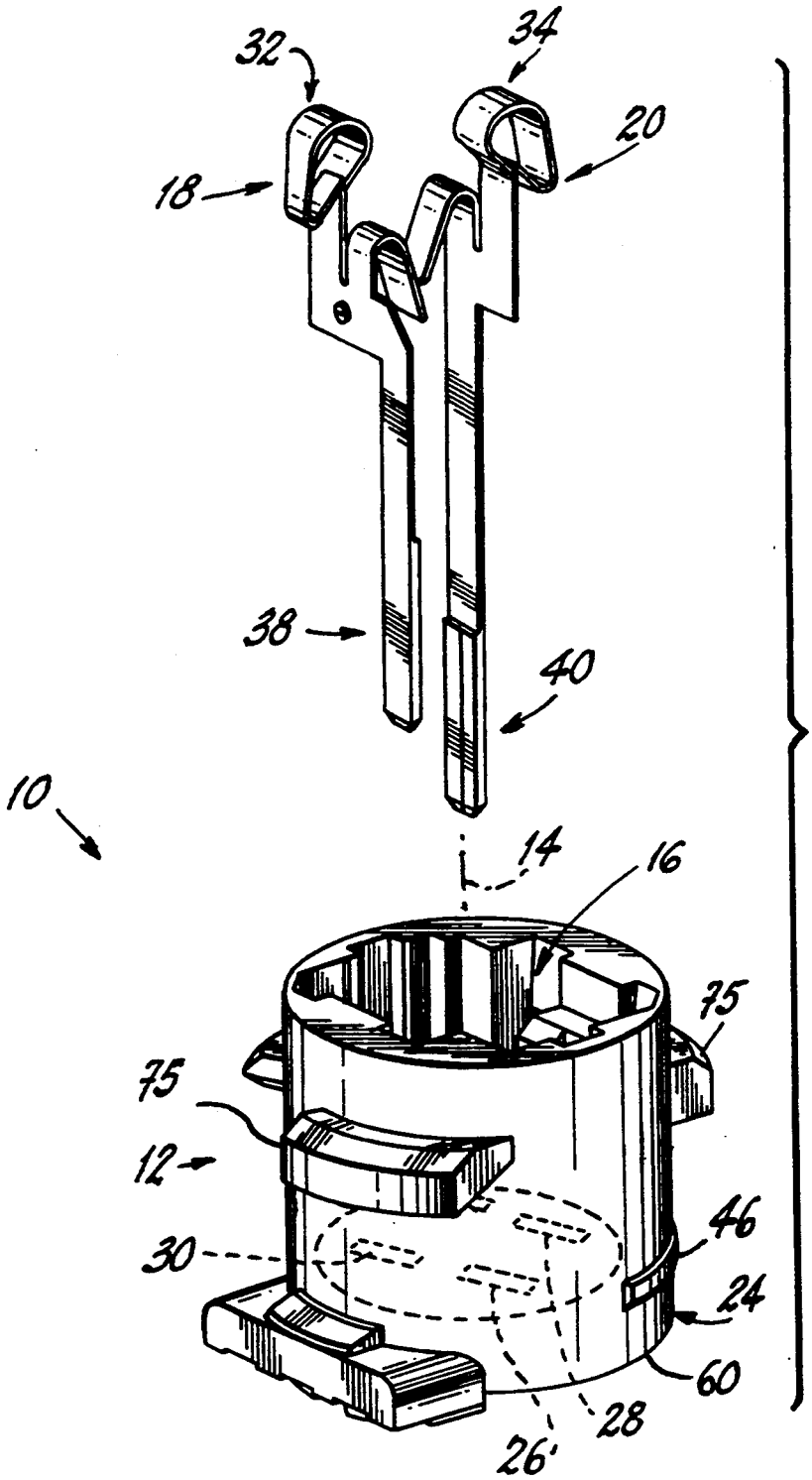
FIG. 1 is an exploded perspective view of a socket body and a pair of contacts.
Figure 2:
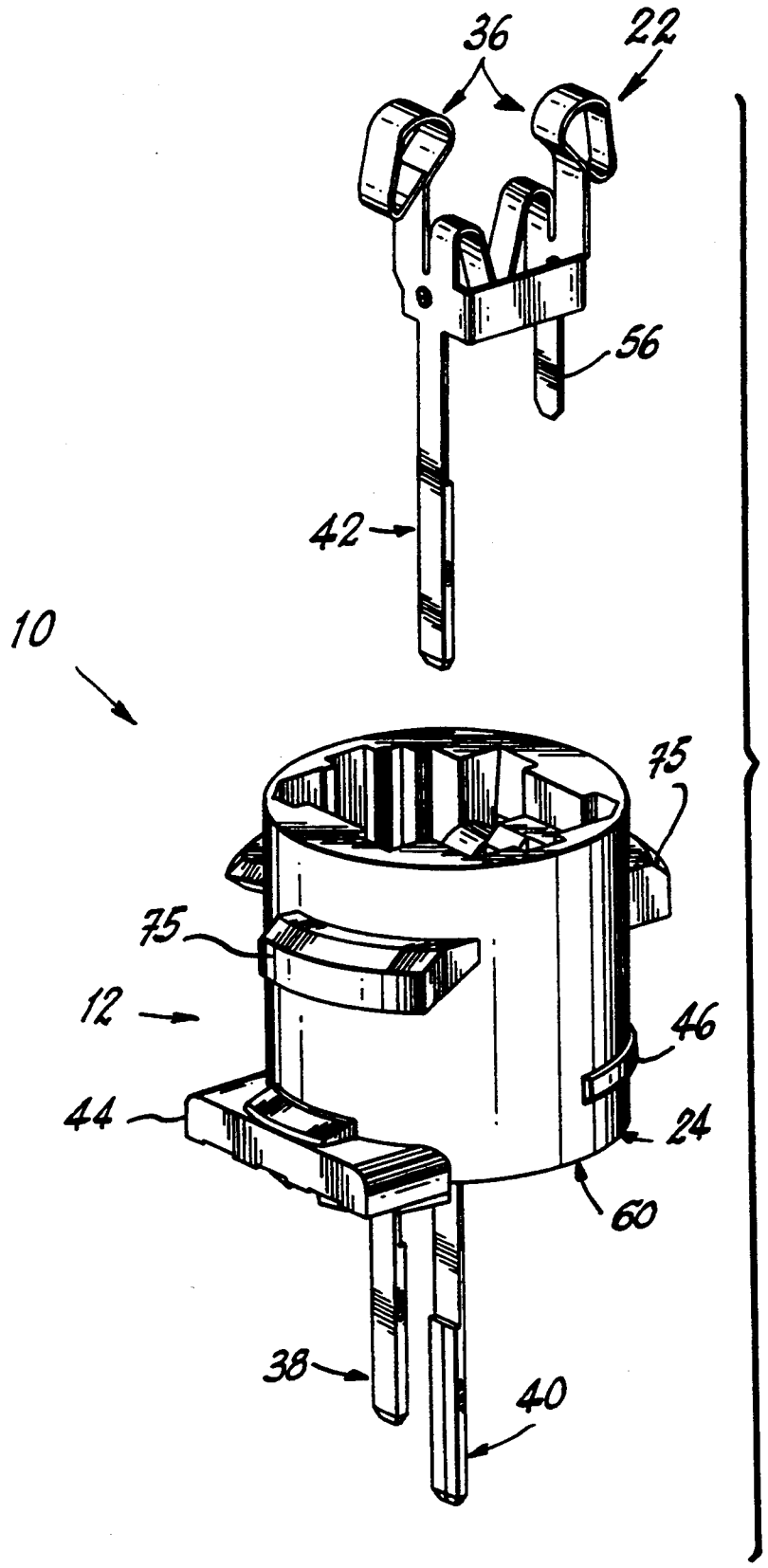
FIG. 2 is a similar view including an additional contact.

Referring now to the drawings with greater particularity, there is shown in FIG. 1 a lamp socket 10 having a body 12 disposed about a longitudinal axis 14. Body 12 in a preferred embodiment is fabricated from nylon which is 43% glass filled. The body 12 contains a cavity 16 for receiving a plurality of electrical contacts and a lamp base which is mechanically and electrically mounted therein.

The electrical contacts 18, 20, 22, have lamp receiving portions 32, 34 and 36 which are received in cavity 16, and elongated terminal portions 38, 40, 42 which extend through apertures 26, 28, 30 in bottom 24 of cavity 16.

A number of latching tabs 46, are provided on body 12 adjacent bottom 24 for cooperation with a like number of latching slots 54 which are provided in body receiving compartment 50 of housing 48. Housing 48 is also provided with an elongated terminal receiving shroud 52.

Figure 3:
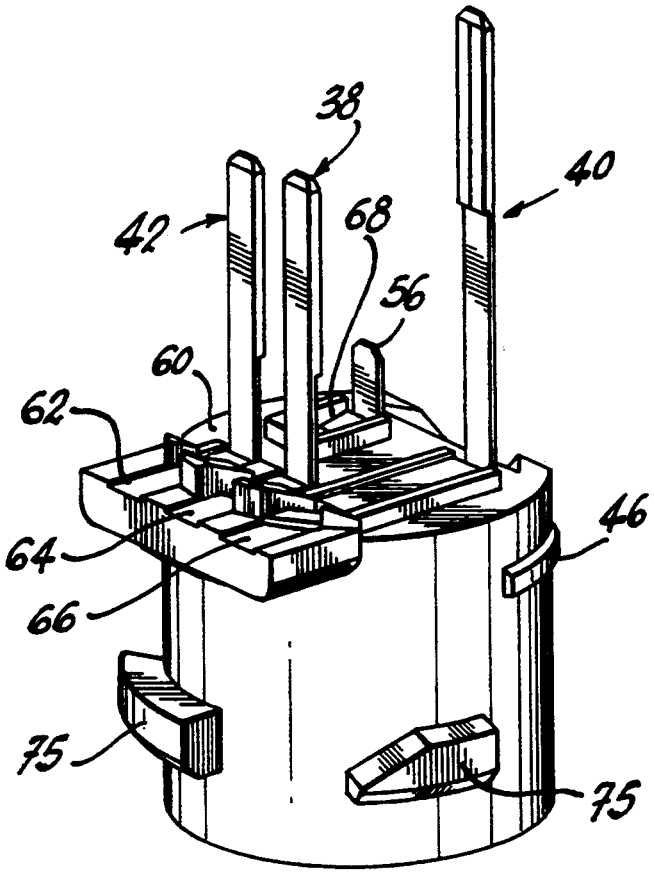
FIG. 3 is a perspective view of the bottom of a socket body with projecting terminals.
Figure 4:
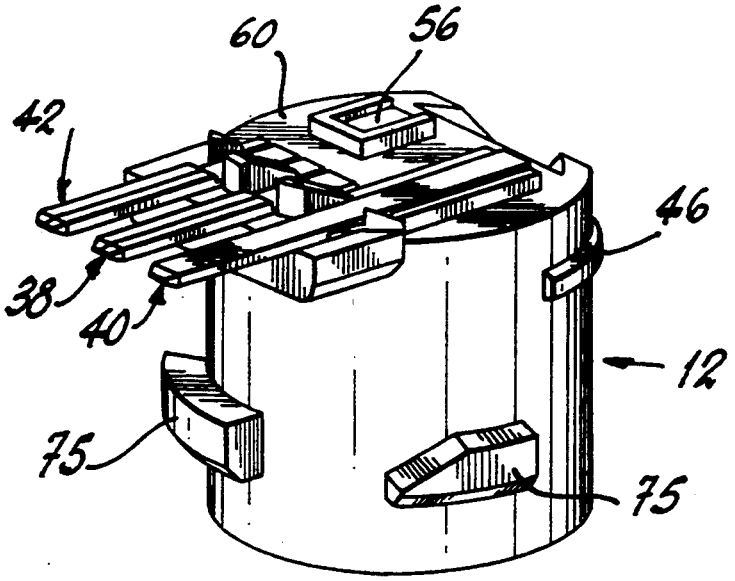
FIG. 4 is a view similar to FIG. 3 illustrating the contact terminals after bending.
Figure 6:
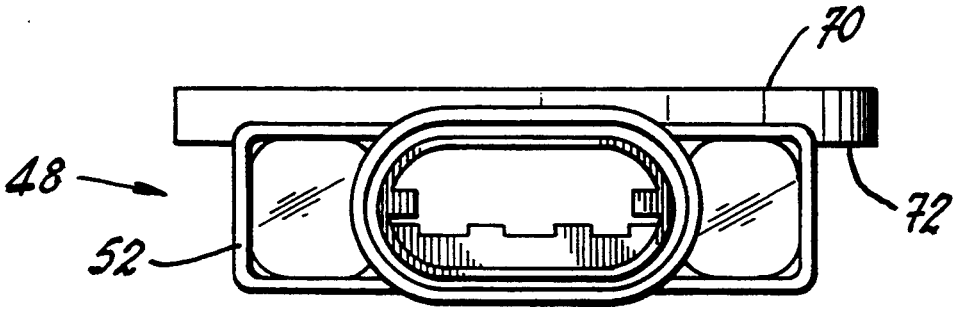
FIG. 6 is an elevational view taken along the line 6—6 of FIG. 5

Terminal portions 38, 40 and 42 of contacts 18, 20 and 22 are preferably about twice as thick as the remaining portions of the contacts for added strength and as noted above, project from the underside of body 12 as shown in FIG. 3. The terminal portions are then bent at substantially 90° to longitudinal axis 14 and lie in slots 62, 64, 66 which are formed in exterior surface 60 of bottom 24 of cavity 16. Terminal portions 38, 40 and 42 extend beyond the periphery 44 of body 12. However, contact 22 has a second terminal portion 56 which does not lie beyond the periphery but, instead, is received in a slot 68. The latter terminal portion functions as an additional holding means for contact 22.

Figure 5:
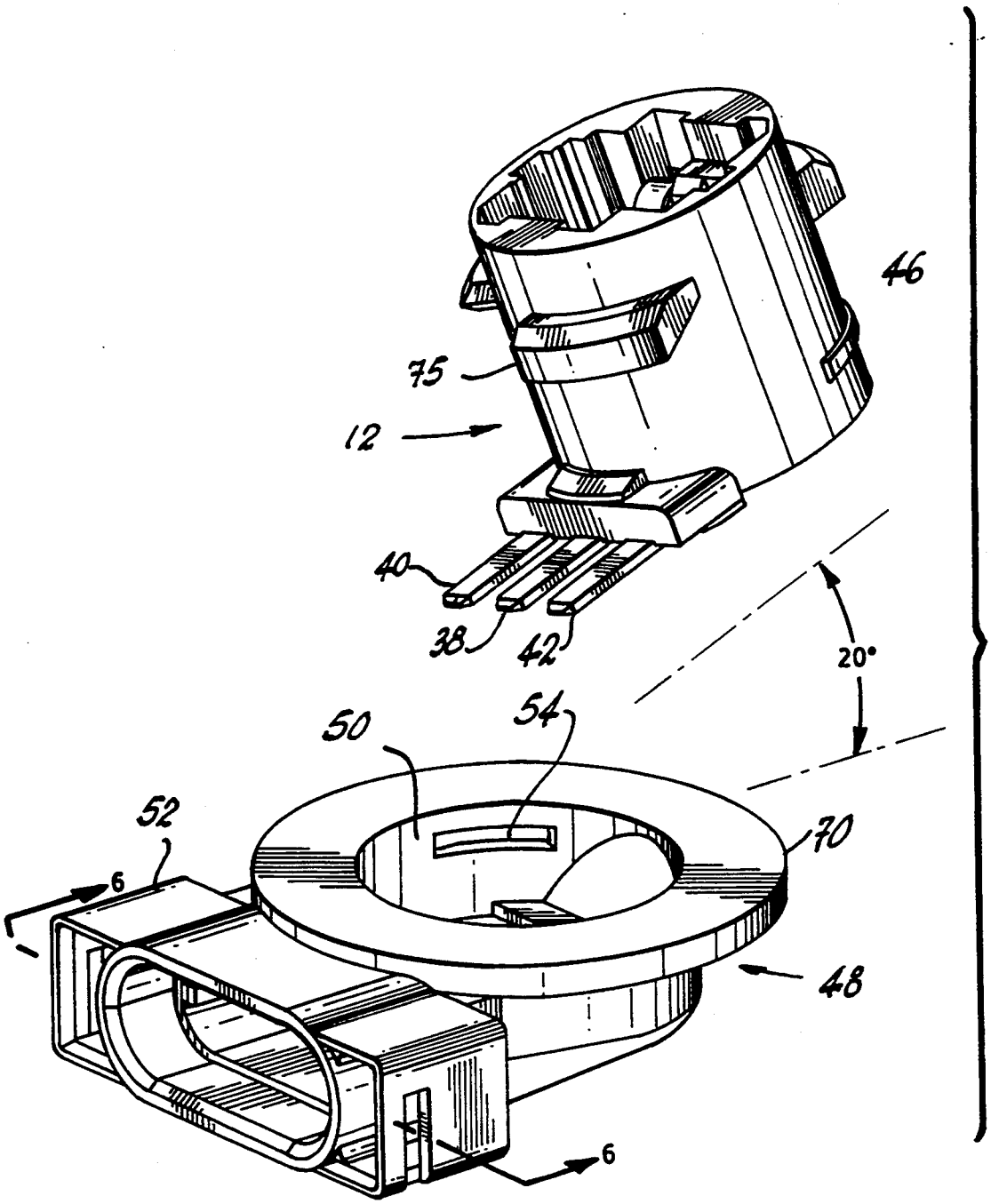
FIG. 5 is an exploded perspective view of a socket body being installed in a housing.
Figure 7:
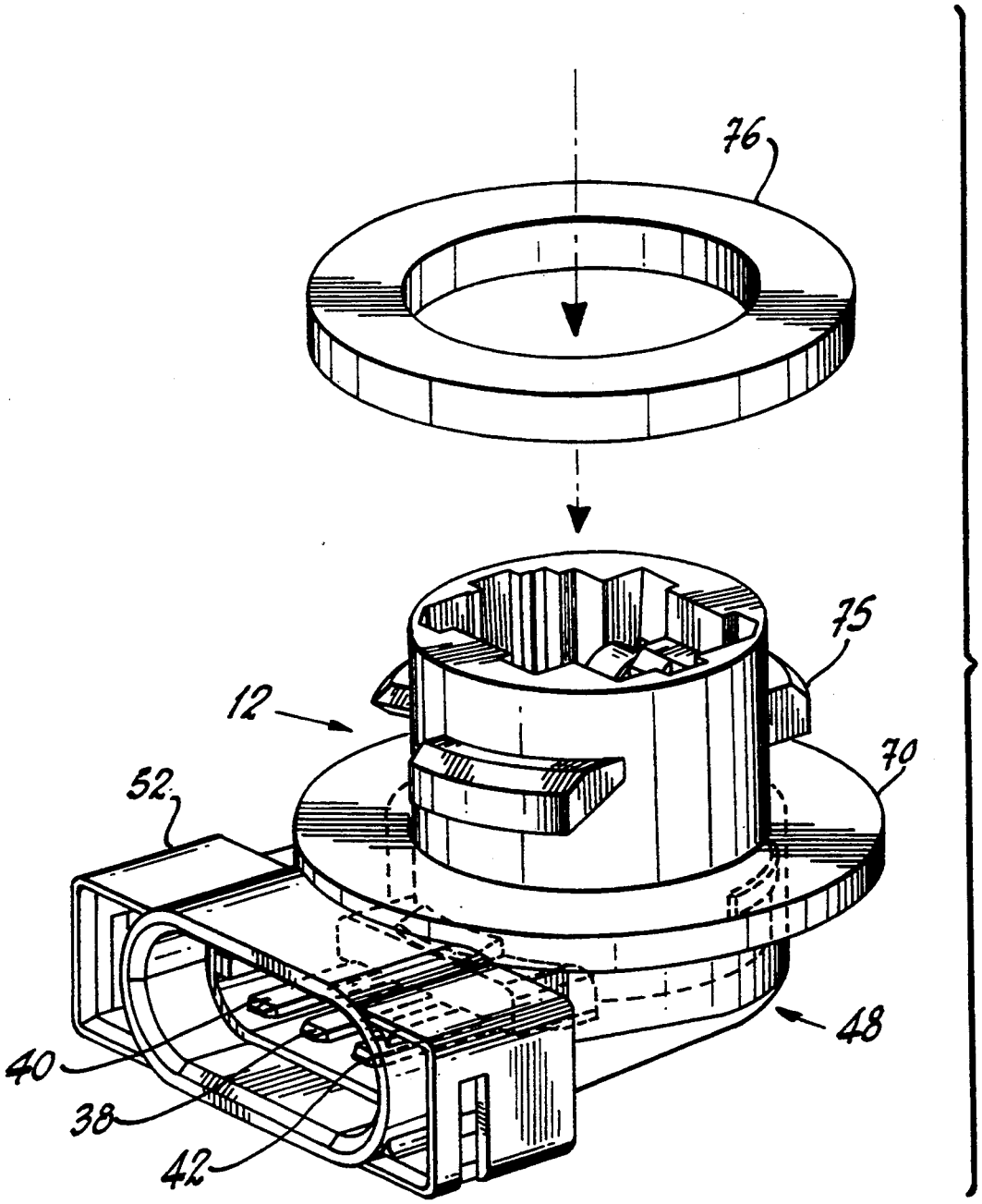
FIG. 7 is an exploded perspective view of an assembled socket and a gasket.
Figure 8:
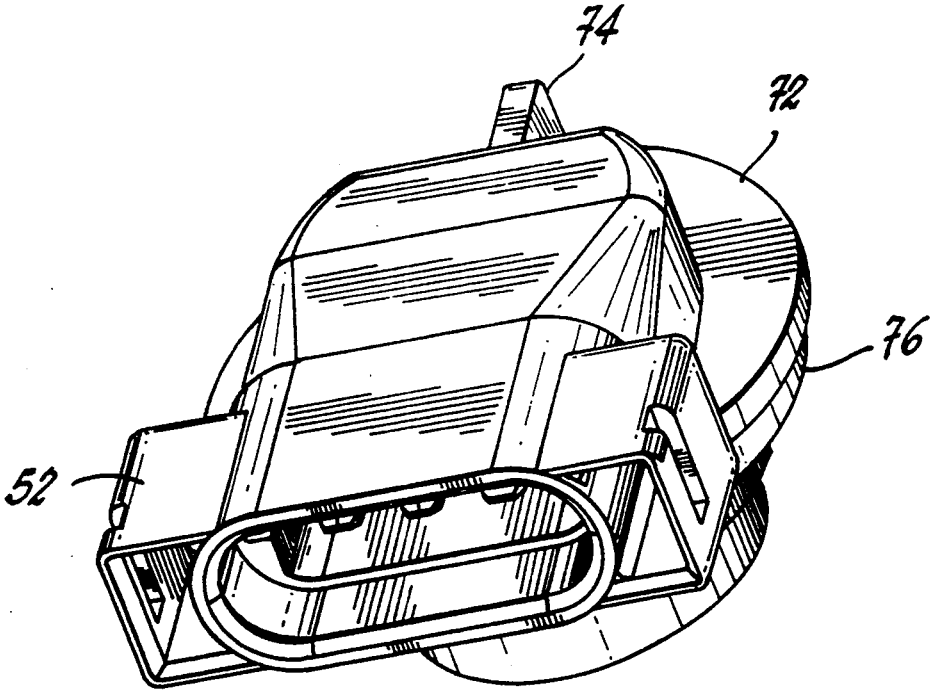
FIG. 8 is a perspective view of the underside of an assembled socket.
Figure 9:
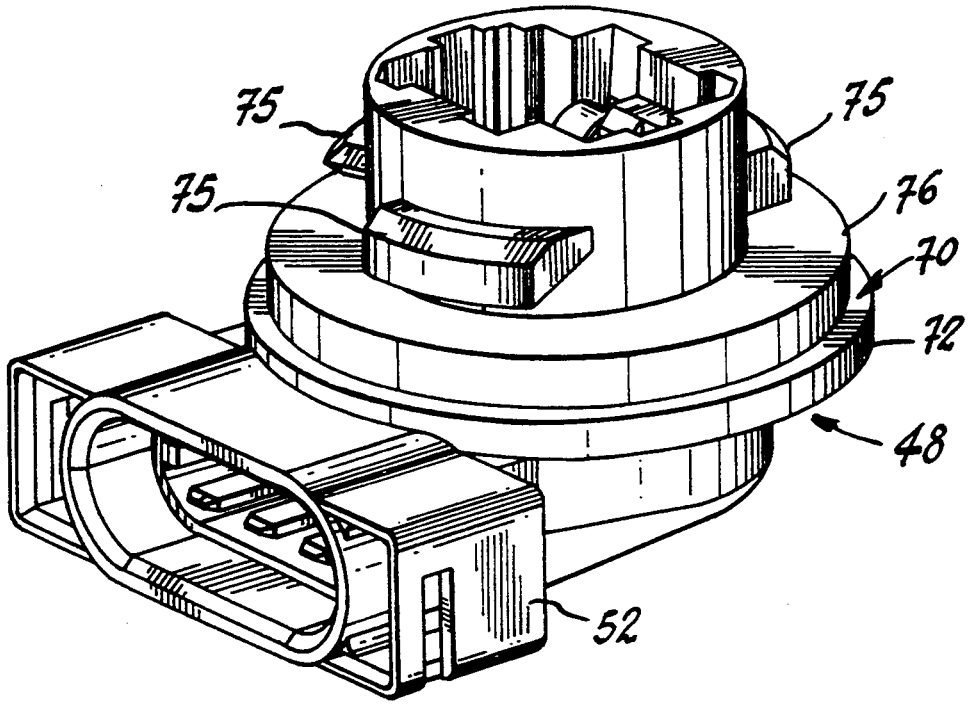
FIG. 9 is a perspective view of a completed socket assembly.

After the contacts are assembled in body 12 and the terminal portions are appropriately formed, the body 12 is inserted in housing 48 as shown in FIGS. 5 and 7. The terminal portions of the contacts which extend beyond the periphery 44 are received in shroud 52 and the latching tabs 46 are received in latching slots 54 to form the lamp socket.

Housing 48 has a gasket reception area 70 surrounding the body receiving compartment 50 for receiving a gasket 76. Typically, the gasket 76 will be a pre-molded Santoprene gasket which will be stretched to fit over the conventional lamp socket threads 75 such that gasket 76 will bear against a reflector housing when the lamp socket is positioned for use. The gasket reception area 70 has an overhang 72 with a leverage ridge 74 formed on the outside of housing 48 and connected to the gasket reception area. The leverage ridge aids in the installation of the lamp socket in a reflector.

There is thus provided an extremely rugged lamp socket having none of the problems of the prior art. Ultrasonic welding of the parts is eliminated and the one-piece contact design with the rugged terminal portion provides for a rigid connection via an appropriate plug which is received in shroud 56. The one-piece contacts also eliminates the need for mechanical crimping and potting.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A lamp socket comprising: a body disposed about a longitudinal axis and having a cavity therein for receiving a plurality of electrical contacts; a bottom to said cavity; a plurality of apertures in said bottom; a plurality of electrical contacts in said cavity, each of said contacts having a lamp receiving portion within said cavity and an elongated terminal portion extending through said apertures and being bent at substantially 90 degrees to said longitudinal axis, said elongated terminal portions extending beyond the periphery of said body; and one of said electrical contacts having a second portion which does not extend beyond said periphery, latching tabs formed on said body adjacent said bottom; and a housing having a body receiving compartment and an elongated terminal portion receiving shroud joined to said housing, said body receiving compartment including latching slots for cooperative engagement with said latching tabs, said body being mounted in said body receiving compartment with said latching tabs being engaged with said latching slots.

2. The lamp socket of claim 1 wherein said electrical contacts have a given thickness and at least a part of said terminal portions have a thickness greater than said given thickness.

3. The lamp socket of claim 1 wherein said bottom has a first surface interior of said cavity and a second surface exterior of said cavity and said second surface contains slots to receive said elongated terminal portions.

4. The lamp socket of claim 2 said thickness greater than said given thickness is twice said given thickness.

5. A lamp socket comprising: a body disposed about a longitudinal axis and having a cavity therein for receiving a plurality of electrical contacts; a bottom to said cavity; a plurality of apertures in said bottom; a plurality of electrical contacts in said cavity, each of said contacts having a lamp receiving portion within said cavity and an elongated terminal portion extending through said apertures and being bent at substantially 90 degrees to said longitudinal axis, said elongated terminal portions extending beyond the periphery of said body; latching tabs formed on said body adjacent said bottom; and a housing having a body receiving compartment and an elongated terminal portion receiving shroud joined to said housing, said body receiving compartment including latching slots for cooperative engagement with said latching tabs, said body being mounted in said body receiving compartment with said latching tabs being engaged with said latching slots, said housing further having a gasket reception area surrounding said body receiving compartment, said gasket reception area having an overhang with respect to said body, and a leverage ridge formed on the outside of said housing and connected to said gasket reception area.

* * * * *